US010619259B2

(12) United States Patent
Peng et al.

(10) Patent No.: US 10,619,259 B2
(45) Date of Patent: Apr. 14, 2020

(54) POLLUTION-FREE ELECTROPLATING SOLUTION FOR ELECTROPLATING AND PREPARATION METHOD THEREOF

(71) Applicant: Ming Chi University of Technology, New Taipei (TW)

(72) Inventors: Kun-Cheng Peng, New Taipei (TW); Min-Zen Lee, New Taipei (TW); Yao-Tien Tseng, New Taipei (TW); Chun-Ying Lee, New Taipei (TW); Po-Yan Su, New Taipei (TW)

(73) Assignee: Ming Chi University of Technology, New Taipei (TW)

( * ) Notice: Subject to any disclaimer, the term of this patent is extended or adjusted under 35 U.S.C. 154(b) by 183 days.

(21) Appl. No.: 15/970,271

(22) Filed: May 3, 2018

(65) Prior Publication Data

US 2019/0024252 A1 Jan. 24, 2019

(30) Foreign Application Priority Data

Jul. 18, 2017 (TW) ..... 106123905 A

(51) Int. Cl.

| | |
|---|---|
| ***C25D 3/18*** | (2006.01) |
| ***C25D 3/22*** | (2006.01) |
| ***C25D 3/38*** | (2006.01) |
| ***C25D 3/48*** | (2006.01) |
| ***C25D 3/46*** | (2006.01) |
| ***C25D 3/66*** | (2006.01) |

(52) U.S. Cl.

CPC ..... *C25D 3/18* (2013.01); *C25D 3/22* (2013.01); *C25D 3/38* (2013.01); *C25D 3/46* (2013.01); *C25D 3/48* (2013.01); *C25D 3/665* (2013.01); *H05K 999/99* (2013.01)

(58) Field of Classification Search

CPC ..... C25D 3/665

See application file for complete search history.

(56) References Cited

U.S. PATENT DOCUMENTS 8,361,300 B2 * 1/2013 Kuzmanovic ..... C25D 3/665 205/234

9,284,264 B2 * 3/2016 Abbott ..... C07C 233/05

* cited by examiner

*Primary Examiner* — Brian W Cohen

(74) *Attorney, Agent, or Firm* — Stevens & Showalter, L.L.P.

(57) ABSTRACT

This disclosure discloses a pollution-free electroplating solution for electroplating and its preparation method. The process of the preparation method includes: mixing choline chloride with nitrogenous compounds in molar ratio of 1:2, heating to 80° C. to form uniform ionic liquid, adding metal chloride into ionic liquid with molar concentration between 0.005M to 0.5 M, adding 7~11 wt % of bio bacteria and 0.7M~2M of inorganic acid agent into the mixed liquid. After been mixed thoroughly, this pollution-free electroplating solution is ready for the application in electroplating.

18 Claims, 4 Drawing Sheets

POLLUTION-FREE ELECTROPLATING SOLUTION FOR ELECTROPLATING AND PREPARATION METHOD THEREOF

CROSS REFERENCE TO RELATED APPLICATION

This application claims the priority benefit of Taiwan Patent Application Serial Number 106123905, filed on Jul. 18, 2017, the full disclosure of which is incorporated herein by reference.

BACKGROUND

Technical Field

This disclosure is related to an electroplating solution for the electrochemical process, and in particular, a pollution-free electroplating solution for electroplating and a preparation method thereof.

Related Art

With the continuous development of consumer electronic gadgets, function is not the only determining factor for the consumers. The gadget's appearance has become another important factor as well. In this regards, the structural and exterior parts of most consumer electronic products are made of Al or Al—Mg alloys. However, for aesthetic consideration, the exterior parts of mobile phones, computer and digital cameras require further surface treatment. Among the commonly used surface treatments, electroplating usually gives the product metallic appearance with better touch quality and durability.

Electroplating is the frequently used surface treatment in which the workpiece is submerged in a container filled with electroplating solution and the externally applied electric current reduced the metallic ions onto workpiece's surface to form a coating. The metallic coating can have both functional and aesthetic effects. However, the wastes from the electroplating process, such as deserted electroplating solution, surface impurities and metallic sedimentation et al., if not properly treated or recycled, become potential threats to the water resource and pollutants to the land in our environments. Therefore, regulations require the electroplating factories to well process the wastes before they can be disposed. The pollution prevention treatment adds cost to the conventional electroplating process.

In a rough categorization, electroplating electroplating solutions can be divided into cyanide and no cyanide systems. Because of the better stability in electroplating process, cyanide electroplating solution is main system adopted by conventional manufacturers. Nevertheless, the cyanide is very toxic in nature and poses tremendous threat to workers in the production lines. Only the safety protocol is strictly followed and the well waste treatment is guaranteed, the worker's health and environmental safety can be assured. The possible threats from electroplating process mostly derive from the electroplating solution, for example, the heavy metal ions such as Ni, Cu and Cr in the electroplating solution, and the corrosive agents such as sulfuric acid and hydrochloric acid in the pretreatment. With the ever soaring conscience in water/land conservation of the society, the management of liquid waste from electroplating industry becomes an important task.

In terms of the possible problem faced by the conventional electroplating industry, this disclosure provides a pollution-free electroplating solution and its preparation method to solve the drawbacks and the limitations of the prior art mentioned above.

SUMMARY

In view of the disadvantages or limitations in the above prior art, the disclosure provides a pollution-free electroplating solution and a preparation method thereof to reduce the possible threats of electroplating electroplating solution to the ecology and safety of the environment. The disclosure provides a pollution-free electroplating solution applicable to electroplating process with anodes. The electroplating solution includes choline chloride, nitrogenous compound, metal chloride, bio bacteria and inorganic acid. The process of the preparation method includes: mixing choline chloride with nitrogenous compounds in molar ratio of 1:2, heating to 80° C. to form uniform ionic liquid, adding metal chloride into ionic liquid with molar concentration between 0.005M to 0.5 M, adding 7~11 wt % of bio bacteria and 0.7M~2M of inorganic acid agent into the ionic liquid.

In one embodiment, the pollution-free electroplating solution further includes saccharin added into the ionic liquid. The molar concentration of the added saccharin is between 0.05M and 0.2M.

In one embodiment, the nitrogenous compound in the pollution-free electroplating solution of the disclosure can be ammonia, urea or uric acid.

In one embodiment, the metal chloride contained i in the pollution-free electroplating solution of the disclosure can be nickel chloride, copper chloride, cobalt chloride, zinc chloride, gold chloride or silver chloride, depending on the coating material demanded.

In one embodiment, the inorganic acid agent in the pollution-free electroplating solution of the disclosure can be nitric acid ($HNO_3$), boric acid ($H_3BO_3$), hydrobromic acid (HBr) or perchloric acid ($HClO_4$).

In one embodiment, the pollution-free electroplating solution of the disclosure further includes glycerol ($C_3H_8O_3$) which is added with the inorganic acid agent first. The glycerol and the inorganic acid mix and form compound lipid.

In one embodiment, in the pollution-free electroplating solution of the disclosure, the volume fraction of the inorganic acid and glycerol is between 4:1 to 3:1.

In one embodiment, the bio bacteria in the pollution-free electroplating solution of the disclosure can be saccharomycetes, *Lactobacillus casei* strain shirota, photosynthetic bacteria, *Lactobacillus, Bacillus* and its combination, or fermented milk.

In one embodiment, the pollution-free electroplating solution of the disclosure includes chitin ($(C_8H_{13}O_5N)_n$) which is added into the inorganic acid agent.

The disclosure further provides a method for preparing the pollution-free electroplating solution. The method includes steps of: mixing choline chloride with nitrogenous compounds in molar ratio of 1:2, and heating to 80° C. to form uniform ionic liquid, adding metal chloride into ionic liquid with molar concentration between 0.005M to 0.5 M, and stirring the ionic liquid added with the metal chloride, adding 7~11 wt % of bio bacteria and 0.7M~2M of inorganic acid agent into the ionic liquid added with the metal chloride, and stirring the ionic liquid added with the bio bacteria and the inorganic acid agent.

In one embodiment, in the method of preparing pollution-free electroplating solution of the disclosure, after the step of adding the bio bacteria and the inorganic acid into the ionic liquid with metal chloride, the method further includes the steps: adding saccharin into the ionic liquid having the bio bacteria and the inorganic acid and stirring the ionic liquid added with the saccharin. The molar concentration of the saccharin added into the ionic liquid is within the range from 0.05M to 0.2M.

In one embodiment, in the method of preparing pollution-free electroplating solution of the disclosure, the nitrogenous compound is selected from ammonia, urea or uric acid.

In one embodiment, in the method of preparing pollution-free electroplating solution of the disclosure, the metal chloride is selected from nickel chloride, copper chloride, cobalt chloride, zinc chloride, gold chloride or silver chloride, depending on the coating material demanded.

Furthermore, in the method of preparing pollution-free electroplating solution of the disclosure, the inorganic acid agent is selected nitric acid ($HNO_3$), boric acid ($H_3BO_3$), hydrobromic acid (HBr) or perchloric acid ($HClO_4$).

In one embodiment, in the method of preparing pollution-free electroplating solution of the disclosure, the step of adding the bio bacteria and the inorganic acid into the ionic liquid with metal chloride further includes a step of adding glycerol ($C_3H_8O_3$) into the inorganic acid, the glycerol and the inorganic acid combining and forming compound lipid.

In one embodiment, in the method of preparing pollution-free electroplating solution of the disclosure, the volume fraction of the inorganic acid and glycerol is between 4:1 to 3:1.

In one embodiment, in the method of preparing pollution-free electroplating solution of the disclosure, the bio bacteria can be saccharomycetes, *Lactobacillus casei* strain shirota, photosynthetic bacteria, *Lactobacillus, Bacillus* and their combination, or fermented milk.

In one embodiment, in the method of preparing pollution-free electroplating solution of the disclosure, the step of adding bio bacteria and inorganic acid into the ionic liquid with metal chloride further includes a step of adding chitin ($(C_8H_{13}O_5N)_n$) into the inorganic acid agent.

The electroplating solution prepared with the disclosed method in this disclosure, when applied in electroplating process and equipment, is able to deposit a metallic coating on the workpiece. It may prevent and protect the workpiece from corrosion, and preserve the workpiece with metallic quality and glossy appearance. Most importantly, the ingredients used in the compositions of the electroplating solution are nontoxic and eco-friendly. Even the inorganic acid is in weakly acidic nature. Therefore, the possible impact to the working environment and ecosystem is minimized. The current idea of green and environmental friendliness is well preserved.

Furthermore, the characteristics of the electroplating solution disclosed in this disclosure are largely dependent of the bio bacteria used. By controlling the concentration and number of species of the bio bacteria in the electroplating solution, the electrical property of the electroplating solution can be reset or adjusted. Therefore, the electroplating solution can be reused after composition retuned. In other words, the gradually deactivated electroplating solution can be reactivated by replenishing the concentration of bio bacteria. No electroplating solution replacement is required even after a long period of operation.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the invention are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Figure 1:
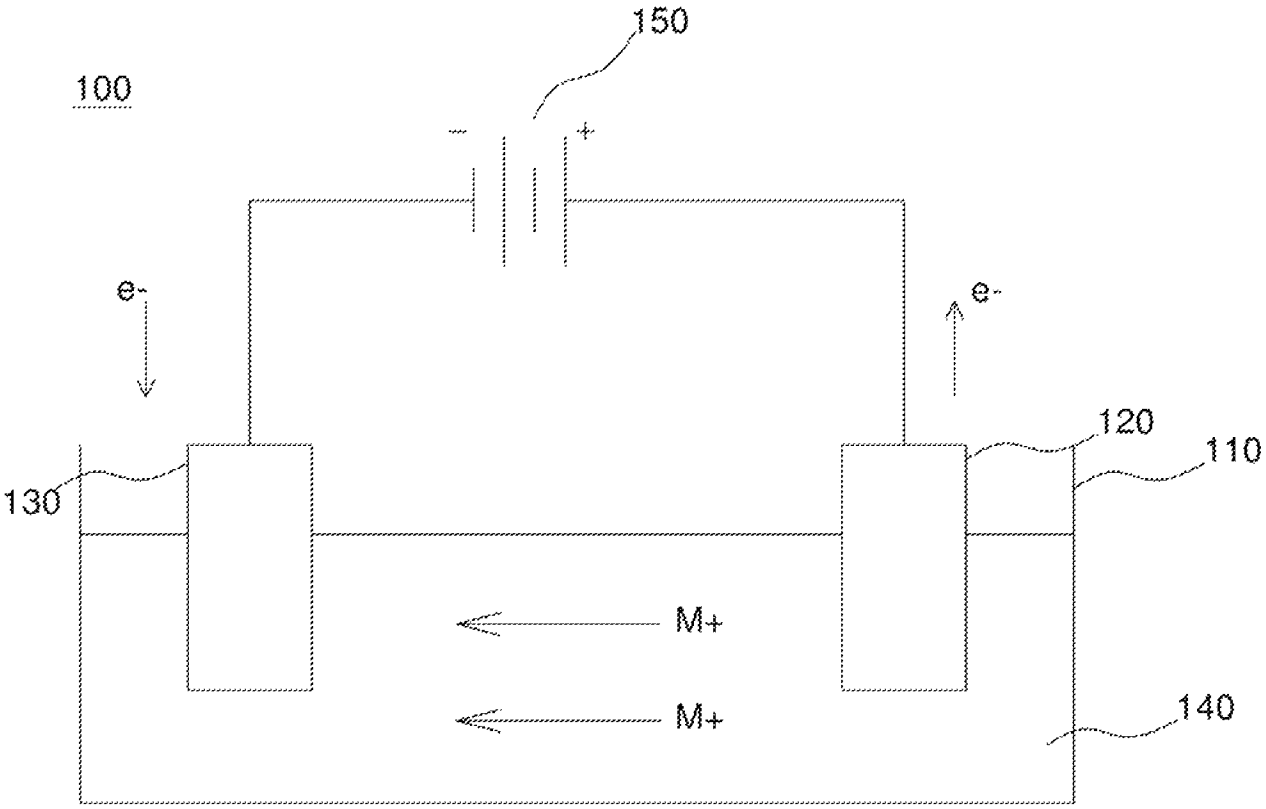
FIG. 1 depicts the schematic diagram of an exemplary electroplating equipment used with the pollution-free electroplating solution disclosed in this disclosure.

FIG. 1 depicts the schematic diagram of an exemplary electroplating equipment used in this invention. The pollution-free electroplating solution 140 can be applied to the electroplating process with anode. This pollution-free electroplating solution 140 is contained in the electroplating container 110 of the electroplating equipment 100. Inside the electroplating container 110, the target 120 and the workpiece 130 are separated and at least partially submerged in the pollution-free electroplating solution 140.

The target 120 is connected electrically to the anode of the electrical power supply 150. The target 120 must consist of conductive material. The workpiece 130 is electrically connected to the cathode of the power supply 150. In the electroplating process, the power supply 150 provides direct current through the target 120 and the workpiece 130. The reactions at the anode and cathode are oxidation $M \rightarrow M^+ + e^-$ and reduction $M^+ + e^- \rightarrow M$, respectively. More specifically, the target releases electrons $e^-$ and becomes metallic ions $M^+$ which are dissolved into the electroplating solution 140. On the other hand, the metallic ions $M^+$ in the electroplating solution 140 receive electrons $e^-$ from the cathode, reduce into metallic atoms and deposit on the surface of the workpiece 130.

It should be mentioned that the current density used in the described electroplating process is very low. It is usually in the range of 0.001-0.005 A/cm$^2$. The corresponding deposition rate of the coating is around 4 μm/hour. However, the working current density in different applications can be easily adjusted to the required deposition rate by any skilled personnel in this electroplating field to obtain the most suitable deposition rate. The disclosed current density should not limit the applicability of this invention.

Before the electroplating process, the workpiece 130 is usually ground by emery papers or rinsed by diluted hydrochloric acid to remove the oxidation stain on its surface. Subsequently, the workpiece 130 is submerged in sodium hydroxide solution to remove grease residues. Finally, the pretreatment to the workpiece 130 is completed with fully rinse of distilled water. After the electroplating is finished, the workpiece 130 is taken out from the electroplating container 110. Then, the residual electroplating solution on workpiece 130 is washed away with distilled water followed by acetone rinse to remove the distilled water. Then the metal workpiece 130 deposited with a coating is obtained. Mostly, the electroplating is conducted at room temperature. No heating to the electroplating solution 140 is required. However, for usual practice a magnetic stirrer is used to enhance the mixing in the electroplating solution 140. The rotating speed of the stirrer can influence the internal stress of the coating plated on the workpiece 130. Moreover, the faster the stirrer agitates the glossier appearance the plated coating becomes. A rotating speed is from 300 rpm (revolution per minute) to 1,000 rpm may be applied.

Figure 2:
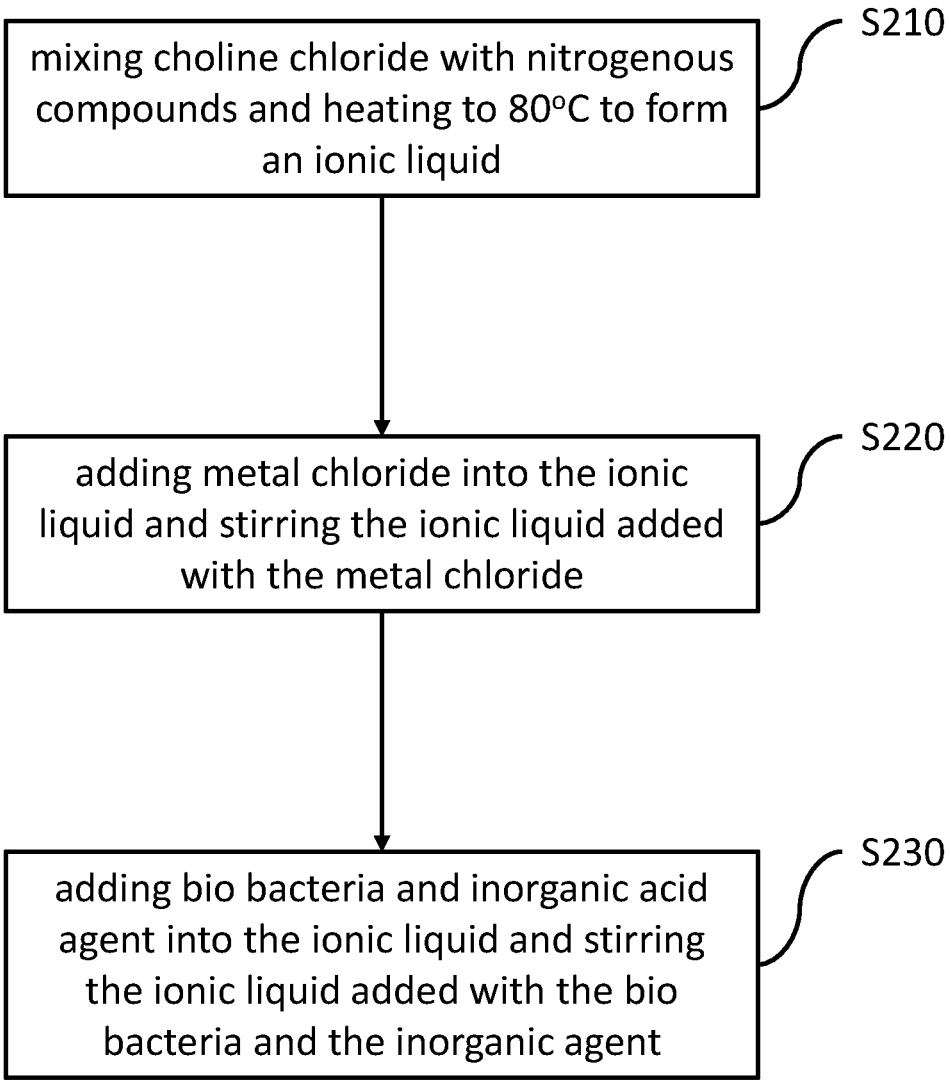
FIG. 2 shows the process flowchart for the preparation of the pollution-free electroplating solution in accordance with the first embodiment.

The process flowchart shown in FIG. 2 is the first embodiment of the preparation method of the pollution-free electroplating solution. The preparation steps include: firstly mixing choline chloride with nitrogenous compounds in molar ratio of 1:2, and heating to 80° C. to form a clear and transparent ionic liquid (Step S210).

The nitrogenous compounds used in this embodiment is selected from ammonia, urea or uric acid. For example, the choline chloride concentration is 560 g/L or 4M in molar concentration. The urea concentration is 480 g/L or 8M in molar concentration. The ratio between their molar concentration equals 1:2. Nevertheless, the concentrations of choline chloride and urea employed in this embodiment can vary between 460 g/L to 660 g/L and 380 g/L to 580 g/L, respectively. The ionic liquid is the mixing of 560 g/L choline chloride and 480 g/L urea.

Subsequently, the method involves adding metal chloride into the ionic liquid and stirring the ionic liquid added with the metal chloride (Step S220). The molar concentration of metal chloride in ionic liquid is controlled within 0.005M to 0.5M. More specifically, in this embodiment the metal chloride is selected from nickel chloride ($NiCl_2$), copper chloride ($CuCl_2$), cobalt chloride ($CoCl_2$), zinc chloride ($ZnCl_2$), gold chloride ($AuCl_3$) or silver chloride (AgCl). It should be noted that the purpose of adding metal chloride is simply to provide the source of metallic ion for the reduction of coating on workpiece. Therefore, the only requirement is to add the chemical which can dissolve and provide the same metallic ions as the target metal in the electroplating. The use of metal chloride as disclosed in this disclosure is not a limitation in application. Taking nickel chloride as an example, the concentration of adding $NiCl_2$—$6H_2O$ in the ionic liquid is 120 g/L or 0.5M in molar concentration. The feasible range of adding nickel chloride in the ionic liquid in this disclosure is from 90 g/L to 150 g/L and in one embodiment the concentration is 120 g/L.

If zinc chloride is used as the metal chloride mentioned in the ionic liquid, the concentration is 27 g/L or 0.2M in molar concentration. For copper chloride, the concentration of copper(II) chloride dihydrate ($CuCl_2$—$2H_2O$) in ionic liquid is 1 g/L or 0.006M in molar concentration. For gold chloride, its concentration is 500 mg/mL or 0.005M in molar concentration.

Next, bio bacteria and inorganic acid agent are added into the ionic liquid and mix uniformly (Step S230). The weight fraction of added bio bacteria in ionic liquid is between 7 wt % to 11 wt % while the molar concentration of the added inorganic acid agent is between 0.7M to 2M. The purpose of adding inorganic acid agent in the pollution-free electroplating solution disclosed in this disclosure is to stabilize the pH value (hydrogen ion concentration index). After adding bio bacteria and inorganic acid agent, the electroplating solution disclosed in this invention becomes weak acidic and its pH is around 4.

The bio bacteria 224 used in this embodiment can be saccharomycetes, *Lactobacillus casei* strain shirota, photosynthetic bacteria, *Lactobacillus, Bacillus* and combination thereof. In addition, the bio bacteria 224 can also be fermented milk, e.g. yogurt. The inorganic acid agent employed in this embodiment can be, but not limited to, weak acidic agent such as nitric acid ($HNO_3$), boric acid ($H_3BO_3$), hydrobromic acid (HBr) or perchloric acid ($HClO_4$). The concentration of the bio bacteria in this embodiment for instance is 20 mL/200 mL or 9 wt % in weight fraction. The concentration of boric acid used is 20 g/200 mL or 1.62M in molar concentration. Moreover, their concentration ranges of in this embodiment can be from 15 mL/200 mL to 25 mL/200 mL for the bio bacteria and 15 g/200 mL to 25 g/200 mL for the boric acid, respectively. In one embodiment, the concentrations are 20 mL/200 mL for bio bacteria and 20 g/200 mL for the boric acid, respectively. The mixing of the bio bacteria and the inorganic acid agent in the ionic liquid is performed by using magnetic stirrer at room temperature.

If nitric acid is used as the inorganic acid agent, its concentration ranges from 15 g/200 mL to 25 g/200 mL or 1.2M to 1.98M in molar concentration. If hydrobromic acid is used instead, the range is from 15 g/200 mL to 25 g/200 mL or 0.9M to 1.54M in molar concentration. Or if perchloric acid is employed, the concentration range is from 15 g/200 mL to 25 g/20 mL or 0.7M to 1.24M in molar concentration.

In this embodiment, when the quality of the electroplating on the workpiece 130 degrades, further addition of inorganic acid agent in the electroplating solution 140 to dilute the concentration of metallic ions can rejuvenate its function. Therefore, the electroplating solution 140 disclosed in this invention can overcome the problem associated with discarding old electroplating solution in the conventional practice.

Figure 3:
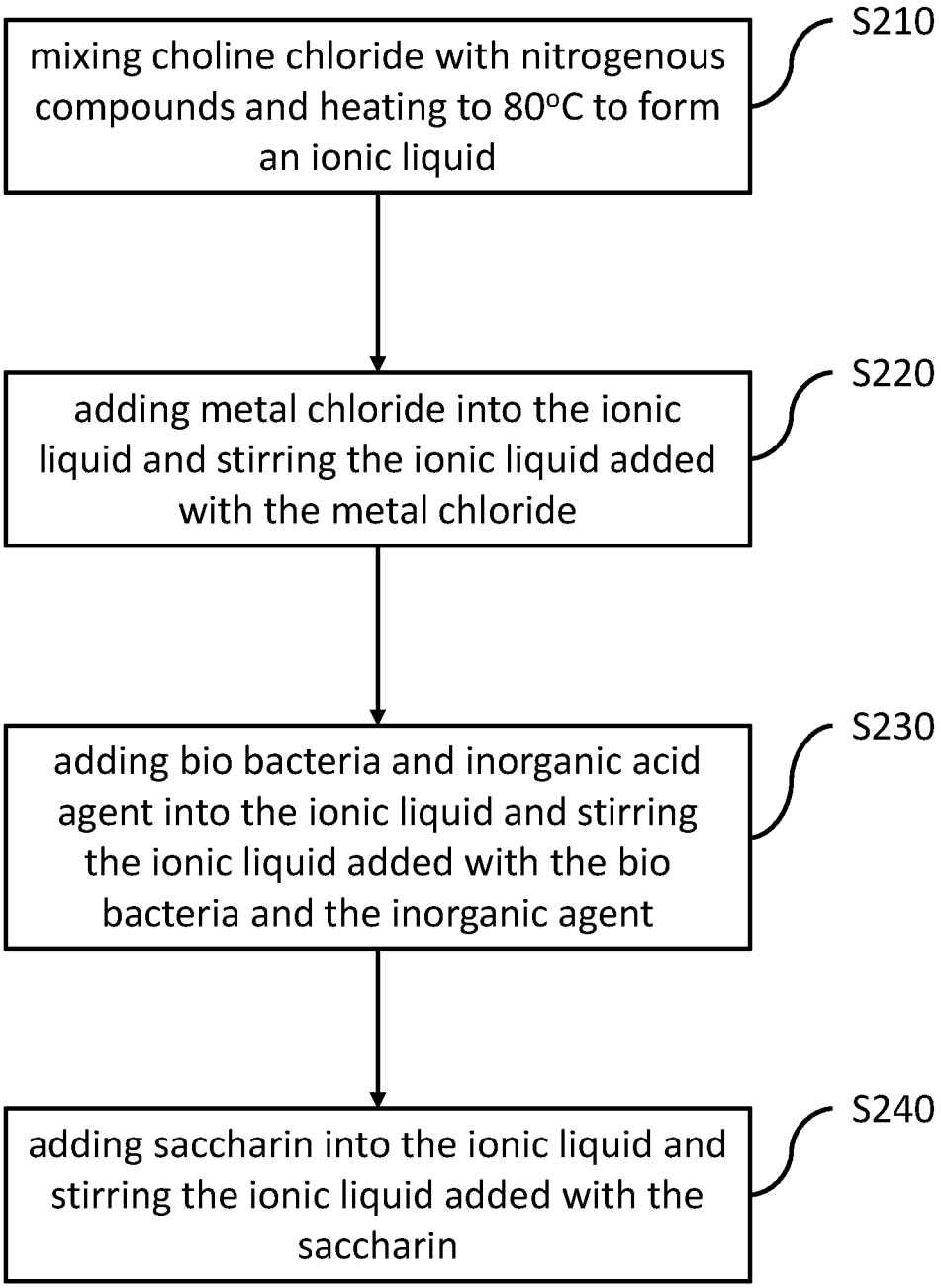
FIG. 3 shows the process flowchart for the preparation of the pollution-free electroplating solution in accordance with the second embodiment.

Shown in the flowchart diagram of FIG. 3 is the second embodiment for the preparation method of the pollution-free electroplating solution disclosed in this disclosure. In addition to the steps S210, S220 and S230 mentioned in the first embodiment, after the mixing of bio bacteria and inorganic acid agent into the ionic liquid (S230), the second embodiment further includes a step of adding saccharin and stirring fully the resulted ionic liquid at room temperature (Step S240). The molar concentration of saccharin can be from 0.05M to 0.2M. The purpose of adding saccharin in this disclosed pollution-free electroplating solution is mainly to reduce the grain and consequently the internal stress of the electroplated coating on the workpiece. An improvement in the surface finish of the workpiece can be obtained.

For instance, the concentration of adding saccharin into the ionic liquid is 2 g/200 mL or 0.05M in molar concentration. The range of saccharin concentration in this embodiment is from 2 g/200 mL to 7 g/200 mL (0.2M) and the preferred one is 2 g/200 mL.

Figure 4:
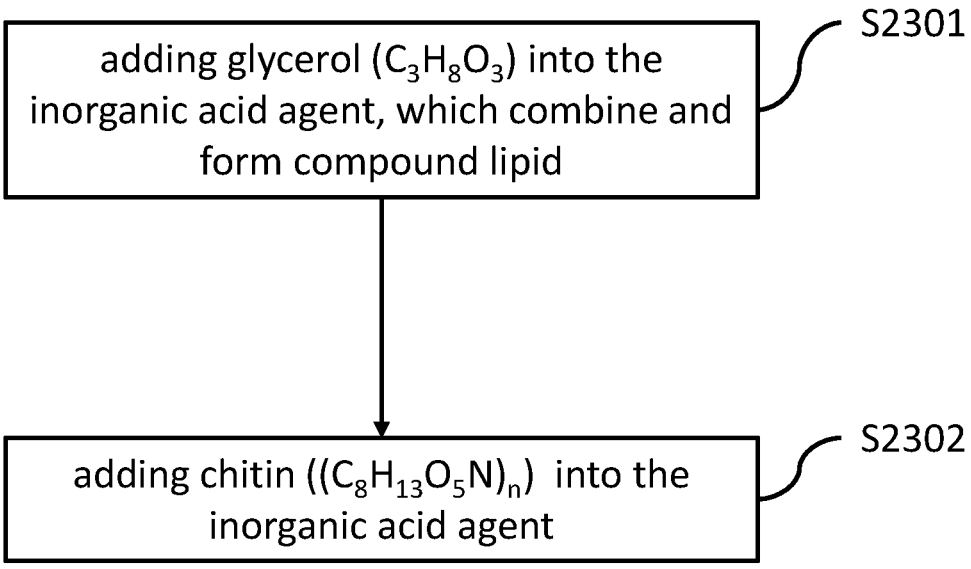
FIG. 4 presents other process flowchart described in step S230 of the exemplary embodiments for the preparation of the pollution-free electroplating solution.

As one embodiment for the preparation method presented in FIGS. 2 and 4, another modification on the Step S230 can be made. Beside the bio bacteria and the inorganic acid in the electroplating solution 140, additional glycerol ($C_3H_8O_3$) can be added into inorganic acid, which combine and form compound lipid (Step 2301). The volume fraction of the inorganic acid and glycerol is between 4:1 to 3:1. It is noted that the glycerol is not directly involved in the electroplating reaction. Its function is to dilute the concentration of metallic ions.

Also shown in FIG. 4, chitin ($(C_8H_{13}O_5N)_n$) can be additionally added into the inorganic acid agent in the preparation of the electroplating solution 140 (Step S2302) to improve the surface characteristics of the workpiece 130. In general, because the electroplating is conducted under anhydrous environment, no significant temperature rise occurs after certain duration of electroplating. Therefore, the degradation rate of the disclosed electroplating solution in this invention can be alienated.

By adjusting the species of the bio bacteria added in the electroplating solution, the duration and current density in electroplating, et al., different results in the surface treatment disclosed in this invention can be obtained.

In summary, the pollution-free electroplating solution prepared from the method disclosed in this disclosure contains mostly non-toxic ingredients and inorganic acid agents which are weakly acidic. When applied in industrial electroplating product process, it presents no serious threat to working environment and ecological system, most importantly, good electroplating performance.

Moreover, the electrical properties of the electroplating solution disclosed in this invention can be rejuvenated by adding or adjusting the bio bacteria species or concentrations to obtain its recyclability. Green and environmental friendliness is conserved with this invention.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the invention. Accordingly, such modifications are considered within the scope of the invention as limited solely by the appended claims.

What is claimed is:

1. A pollution-free electroplating solution for an electroplating process, comprising:

a choline chloride;

a nitrogenous compound, mixed with the choline chloride and heated to 80° C. to form an ionic liquid, wherein the molar concentration ratio between the choline chloride and the nitrogenous compound is 1:2;

a metal chloride, which is added into the ionic liquid, wherein molar concentration of the metal chloride in the ionic liquid ranges between 0.005M to 0.5M;

a bio bacteria, which is added into the ionic liquid, wherein the weight fraction of the bio bacteria in the ionic liquid between 7 wt % to 11 wt %; and an inorganic acid agent, which is added into the ionic liquid, wherein molar concentration of the inorganic acid agent in the ionic liquid ranges between 0.7M to 2M.

2. The pollution-free electroplating solution of claim 1, further comprising a saccharin added into the ionic liquid, wherein the molar concentration of the saccharin in the ionic liquid is between 0.05M to 0.2M.

3. The pollution-free electroplating solution of claim 1, wherein the nitrogenous compound is selected from ammonia, urea or uric acid.

4. The pollution-free electroplating solution of claim 1, wherein the metal chloride is selected from nickel chloride, copper chloride, cobalt chloride, zinc chloride, gold chloride or silver chloride.

5. The pollution-free electroplating solution of claim 1, wherein the inorganic acid agent is selected from nitric acid, boric acid, hydrobromic acid or perchloric acid.

6. The pollution-free electroplating solution of claim 1, further comprising glycerol ($C_3H_8O_3$) which combines with the inorganic acid agent to form a compound lipid.

7. The pollution-free electroplating solution of claim 6, wherein the volume fraction between inorganic acid agent and the glycerol is within 4:1 to 3:1.

8. The pollution-free electroplating solution of claim 1, wherein the bio bacteria is selected from saccharomycetes, *Lactobacillus casei* strain shirota, photosynthetic bacteria, *Lactobacillus, Bacillus* and their combination, or fermented milk.

9. The pollution-free electroplating solution of claim 1 further comprising chitin ($(C_8H_{13}O_5N)_n$) which is added into the inorganic acid agent.

10. A preparation method for a pollution-free electroplating solution, comprising:

mixing a chorine chloride with a nitrogenous compound and heating the mixed chorine chloride and nitrogenous compound to 80° C. to form an ionic liquid, wherein the molar concentration of the chorine chloride and the nitrogenous compound is 1:2;

adding a metal chloride to the ionic liquid and stirring the ionic liquid mixed with the metal chloride, wherein the molar concentration of the metal chloride in the ionic liquid is between 0.005M to 0.5M; and adding a bio bacteria and an inorganic acid agent to the ionic liquid, and stirring the ionic liquid mixed with the bio bacteria and the inorganic acid agent, wherein the weight fraction of the bio bacteria in the ionic liquid is between 7 wt % to 11 wt %, and the molar concentration of the inorganic acid agent in the ionic liquid is between 0.7M to 2M.

11. The preparation method for the pollution-free electroplating solution of claim 10, wherein after the step of adding the bio bacteria and the inorganic acid agent to the ionic liquid mixed with the metal chloride, further comprises:

adding a saccharin to the ionic liquid having bio bacteria and inorganic acid agent, stirring the ionic liquid mixed with the saccharin, wherein the molar concentration of the saccharin in the ionic liquid is between 0.05M to 0.2M.

12. The preparation method for the pollution-free electroplating solution of claim 10, wherein the nitrogenous compound is selected from ammonia, urea or uric acid.

13. The preparation method for the pollution-free electroplating solution of claim 10, wherein the metal chloride is selected from nickel chloride, copper chloride, cobalt chloride, zinc chloride, gold chloride or silver chloride.

14. The preparation method for the pollution-free electroplating solution of claim 10, wherein the inorganic acid agent is selected from nitric acid (HNO3), boric acid (H3BO3), hydrobromic acid (HBr) or perchloric acid (HClO4).

15. The preparation method for the pollution-free electroplating solution of claim 10, wherein the step of adding the bio bacteria and the inorganic acid agent to the ionic liquid mixed with the metal chloride further comprises:

adding a glycerol ($C_3H_8O_3$) to the inorganic acid agent, wherein the glycerol and the inorganic acid agent form a compound lipid.

16. The preparation method for the pollution-free electroplating solution of claim 15, wherein the volume fraction of the inorganic acid agent to the glycerol is between 4:1 to 3:1.

17. The preparation method for the pollution-free electroplating solution of claim 10, wherein the bio bacteria is selected from saccharomycetes, *Lactobacillus casei* strain shirota, photosynthetic bacteria, *Lactobacillus, Bacillus* and their combination, or fermented milk.

18. The preparation method for the pollution-free electroplating solution of claim 10, wherein the step of adding the bio bacteria and the inorganic acid agent to the ionic liquid mixed with the metal chloride further comprises:

adding a chitin ($(C_8H_{13}O_5N)_n$) to the inorganic acid agent.

* * * * *